United States Patent [19]

Meeker

[11] Patent Number: 4,911,499

[45] Date of Patent: Mar. 27, 1990

[54] POWERED ROCKER MECHANISM

[75] Inventor: Paul K. Meeker, Aurora, Ohio

[73] Assignee: Spalding & Evenflo Companies, Inc., Tampa, Fla.

[21] Appl. No.: 258,350

[22] Filed: Oct. 17, 1988

[51] Int. Cl.[4] ..... A47D 1/02

[52] U.S. Cl. ..... 297/260; 297/130; 297/270; 297/281; 5/109

[58] Field of Search ..... 297/130, 258, 260, 270, 297/281, 282, 273; 5/105–109; 403/70, 121, 160

[56] References Cited

U.S. PATENT DOCUMENTS

| | | | |
|---|---|---|---|
| 651,565 | 6/1900 | Finn | 403/121 |
| 727,741 | 5/1903 | Brott | 297/282 |
| 1,545,478 | 7/1925 | Bowsfield | 403/121 |
| 2,646,838 | 7/1953 | Welsh | 297/281 X |
| 3,125,767 | 3/1964 | Griggs et al. | 5/109 |
| 3,414,325 | 12/1968 | Jutila | 297/281 |
| 3,648,307 | 3/1972 | Meade | 5/108 |
| 3,653,080 | 4/1972 | Hafale | 297/260 X |

*Primary Examiner*—Peter R. Brown

*Attorney, Agent, or Firm*—Donald R. Bahr

[57] ABSTRACT

An improved rocker for an infant seat comprising in combination a base having upstanding lateral side walls defining an opening therebetween; an intermediate platform positioned within the opening and having an upper region adapted to receive an infant seat thereon; a pair of generally U-shaped links each having upper portions supported by the side walls, each having a lower horizontal portion adapted to receive a lower region of the platform thereon, and each having intermediate vertical portions coupling the upper and lower portions; drive means coupling the platform and the base for inducing a rocking motion to the platform; adjustment means to longitudinally vary the center of oscillation of the rocking platform; and locking means to lock the platform with respect to the base.

12 Claims, 6 Drawing Sheets

POWERED ROCKER MECHANISM

BACKGROUND OF THE INVENTION

1. Field of the Invention

This invention relates to a rocker assembly for an infant seat and, more particularly, to rocker assembly having a base and an intermediate platform rockable with respect to the base, the platform being configured for supporting an infant seat so that a child thereon may be rocked upon the energization of a motor within the base coupled to the platform.

2. Description Of The Background Art

For centuries it has been appreciated that a rocking motion applied to a reclining child can induce much needed sleep or otherwise relax such child. Historically, cradles have been provided with arcuate supports so that mothers may impart a side-to-side rocking motion to the child within in the cradle. For older children, as well as for adults, chairs with similar arcuate supports have been utilized for imparting a forward to rearward rocking motion. Such rocking chairs or seats have been well known and utilized for many years.

With the advances in technology, however, there has been a continuing effort to improve such rocking cradles and rocking chairs by imparting the desired rocking motion automatically to thereby free up the parent from the task of imparting the motion by hand. Most of such motion imparting mechanisms employed to date have required the use of a special cradle or a special seat for coupling such rocker or seat to the motion imparting mechanisms. As such, complexity and expense are added.

Because of the wide use of rockers and infant seats throughout the world, there is a need for a rocker assembly for supporting a child in a conventional infant seat wherein the infant seat is not of a special construction. Such rocker assemblies should be designed for the safety and comfort of the child in the infant seat, the convenience of the mother employing such infant seat and rocker assembly, and for long lasting usage at a minimum of cost to fabricate and use.

The patent literature shows that many of these design objectives are well recognized. It does not, however, provide a satisfactory solution. Consider for example U.S. Pat. No. 3,653,080 to Hafele; U.S. Pat. No. 3,851,343 to Kinslow; U.S. Pat. No. 4,598,946 to Cone and U.S. Pat. No. 4,656,680 to Wilson. All of these patents disclose infant seats for imparting a rocking motion to the infant seat and the infant reclining therein. But in all instances special construction is required of the infant seat to effect the desired motion. In addition, consider U.S. Pat. No. 2,979,735 to Helmer and U.S. Pat. No. 4,620,334 to Robinson. These patents disclose devices for supporting and rocking a child. But the supported child is in a bassinet rather than an infant seat. In Helmer the rocking motion is side-to-side rather than forward to backward as preferred in an infant seat while the motion in Robinson is in an orbital movement in a fixed plane. In U.S. Pat. No. 4,028,753 to Rios, a cradle is disclosed for a side-to-side movement but the cradle requires special rollers on its lower surface for proper positioning on a base. Lastly, note is taken of U.S. Pat. No. 3,125,767 to Griggs and U.S. Pat. No. 3,648,307 to Meade. These patents disclose mechanisms for imparting motion to a child-supporting device wherein a pair of modified U-shaped supports retain the child in position and effect its rocking.

As illustrated by the great number of prior patents and commercial devices, efforts are continuously being made in an attempt to more safely, conveniently and economically rock infants. None of these previous efforts, however, suggests the present inventive combination of component elements arranged and configured as disclosed and claimed herein. Prior rockers do not provide the benefits attendant with the present invention. The present invention achieves its intended purposes, objects and advantages over the prior art devices through a new, useful and unobvious combination of component elements, through the use of a minimum number of functioning parts, at a reduction in cost to manufacture and use, and through the utilization of only readily available materials.

Therefore, it is an object of the present invention to provide an improved rocker assembly for an infant seat comprising in combination a base having upstanding lateral side walls defining an opening therebetween; an intermediate platform positioned within the opening and having an upper region adapted to receive an infant seat thereon; generally U-shaped link means having upper portions supported by the side walls, a lower horizontal portion adapted to receive a lower region of the platform thereon, and intermediate vertical portions coupling the upper and lower portions; and drive means coupling the platform and the base for inducing a rocking motion to the platform.

It is a further object of this invention to support conventional infant seats on an improved rocker assembly.

A further object of this invention is to provide a rocking motion to a child in a swing in a physical space which is smaller than the space required by conventional swings.

It is a further object of the present invention to economically and conveniently to impart an improved rocking motion to a child reclining in a conventional infant seat.

Lastly, it is an object of the present invention to rock children in a safe, comfortable, convenient and efficient manner.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. For the purposes of summarizing the invention, the invention may be incorporated into a rocker assembly for an infant seat comprising in combination a base having upstanding lateral side walls defining an opening therebetween; an intermediate platform positioned within the opening and having an upper region adapted to receive an infant seat thereon; generally U-shaped link means having upper portions supported by the side walls, a lower horizontal portion adapted to receive a lower region of the platform thereon, and intermediate vertical portions coupling the upper and lower portions; and drive means coupling the platform and the base for inducing a rocking motion to the platform.

The speed of the drive means is adjustable to match the natural period of the platform and child which is about forty (40) cycles per minute as effected by the geometry of the assembly. The link means includes two brackets coupling the opposite ends of the walls with the opposite ends of the platform. The link means are each provided with apertured plates with edges formed as knife edge bearings adapted to engage with journals in the base and platform to thereby constitute low friction hinges. The drive means includes a motor mounted within the base and a mechanism flexibly coupling the motor and the platform whereby movement of one end of the mechanism by the motor will tend to effect a movement of the other end of the mechanism connected to the platform. The mechanism is a leaf spring. The assembly further includes adjustment means to move the drive means and thereby longitudinally vary the center of oscillation of the rocking platform to compensate for varying centers of gravity of the platform and child. The adjustment means is a rotatable knob coupled to the motor and leaf spring for the longitudinal shifting thereof. The assembly further include locking means to secure the platform with respect to the base. The locking means includes a plate downwardly extending from the platform with a plurality of longitudinally spaced slots formed therein and a rod pivotably secured to the base for positioning in a preselected one of the slots for securing the platform in a preselected orientation with respect to the base.

The invention may be incorporated into a rocker for an infant seat comprising in combination a base having upstanding lateral side walls defining an opening therebetween; an intermediate platform positioned within the opening and having an upper region adapted to receive an infant seat thereon; a pair of generally U-shaped links each having upper portions supported by the side walls, each having a lower horizontal portion adapted to receive a lower region of the platform thereon, and each having intermediate vertical portions coupling the upper and lower portions; drive means coupling the platform and the base for inducing a rocking motion to the platform; adjustment means to longitudinally vary the center of oscillation of the rocking platform; and locking means to lock the platform with respect to the base.

Lastly, the invention may be incorporated into a rocker assembly for a child comprising i combination a base having upstanding lateral side walls defining an opening therebetween; an intermediate platform positioned within the opening and having an upper region adapted to support a child; link means having upper portions supported by the side walls, a lower portion adapted to receive a lower region of the platform thereon, and intermediate portions coupling the upper and lower portions; and drive means coupling the platform and the base for inducing a rocking motion to the supported child platform.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar referenced characters refer to similar parts throughout the several Figures.

DETAILED DESCRIPTION OF THE INVENTION

Figure 1:
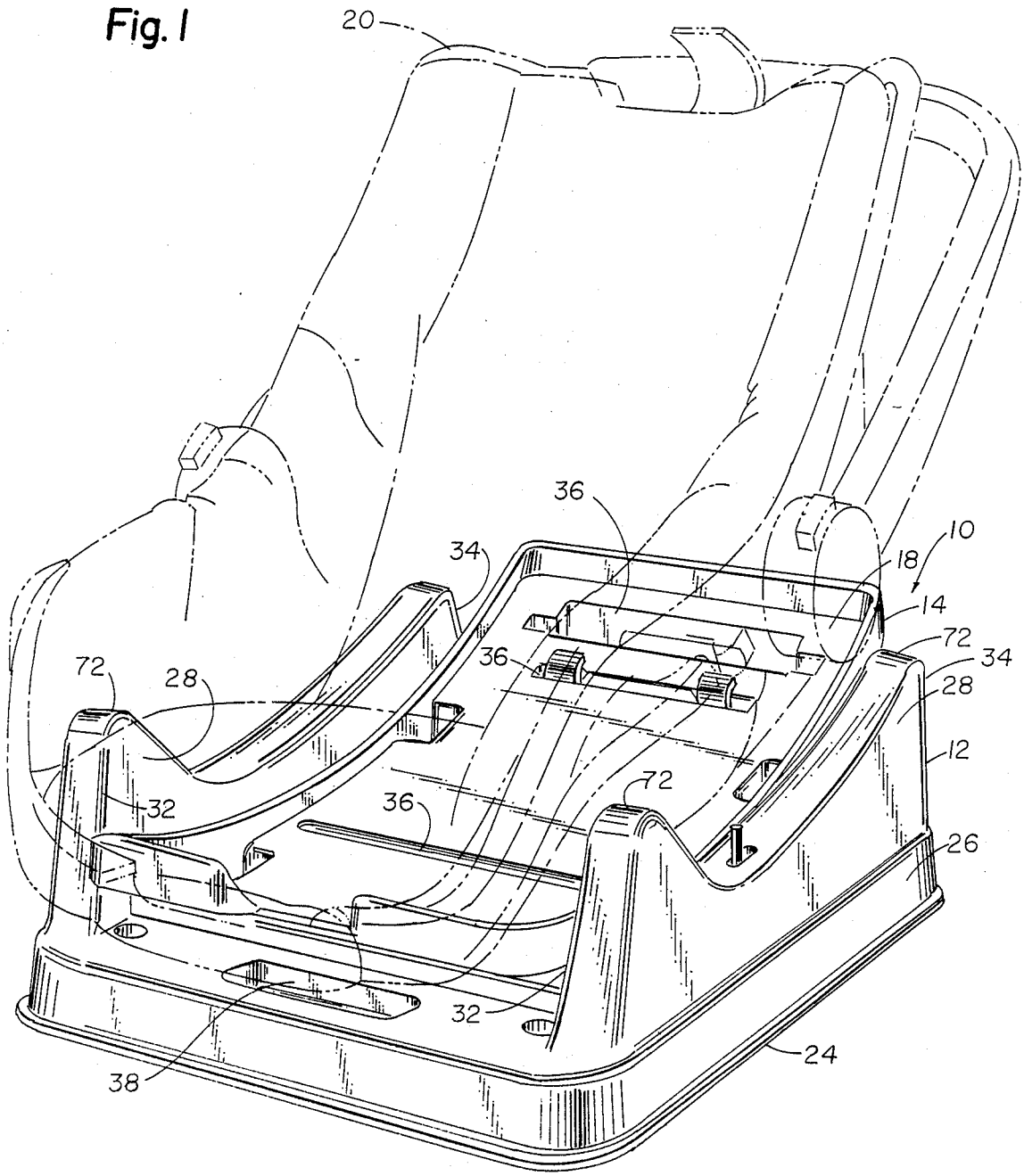
FIG. 1 is a perspective illustration of the rocker assembly constructed in accordance with the principles of the present invention and showing, in phantom lines, an infant seat operative positioned, thereon.
Figure 2:
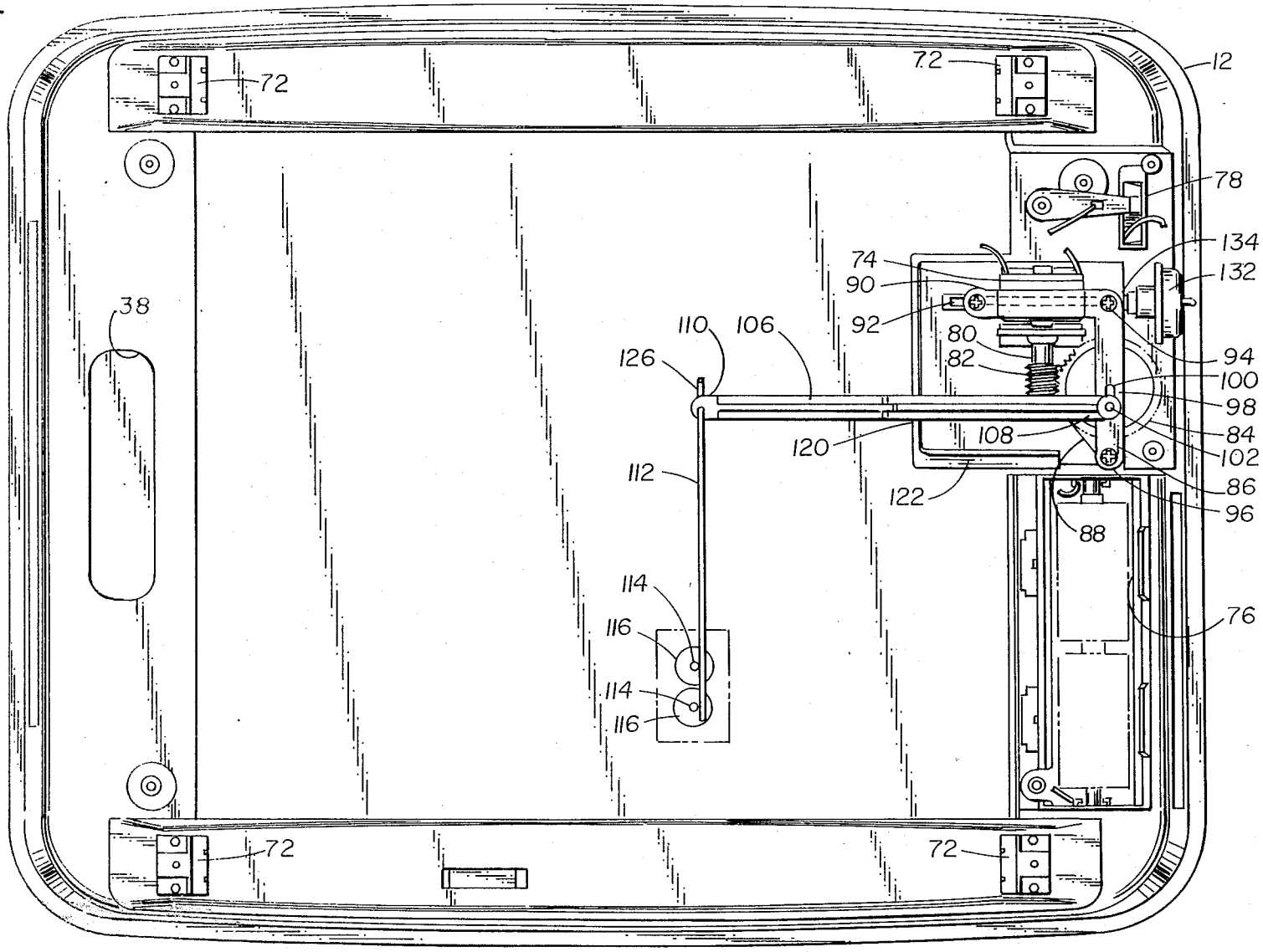
FIG. 2 is a plan view of the rocker assembly shown in FIG. 1 but with the intermediate platform and other components removed to show certain internal construction thereof.
Figure 3:
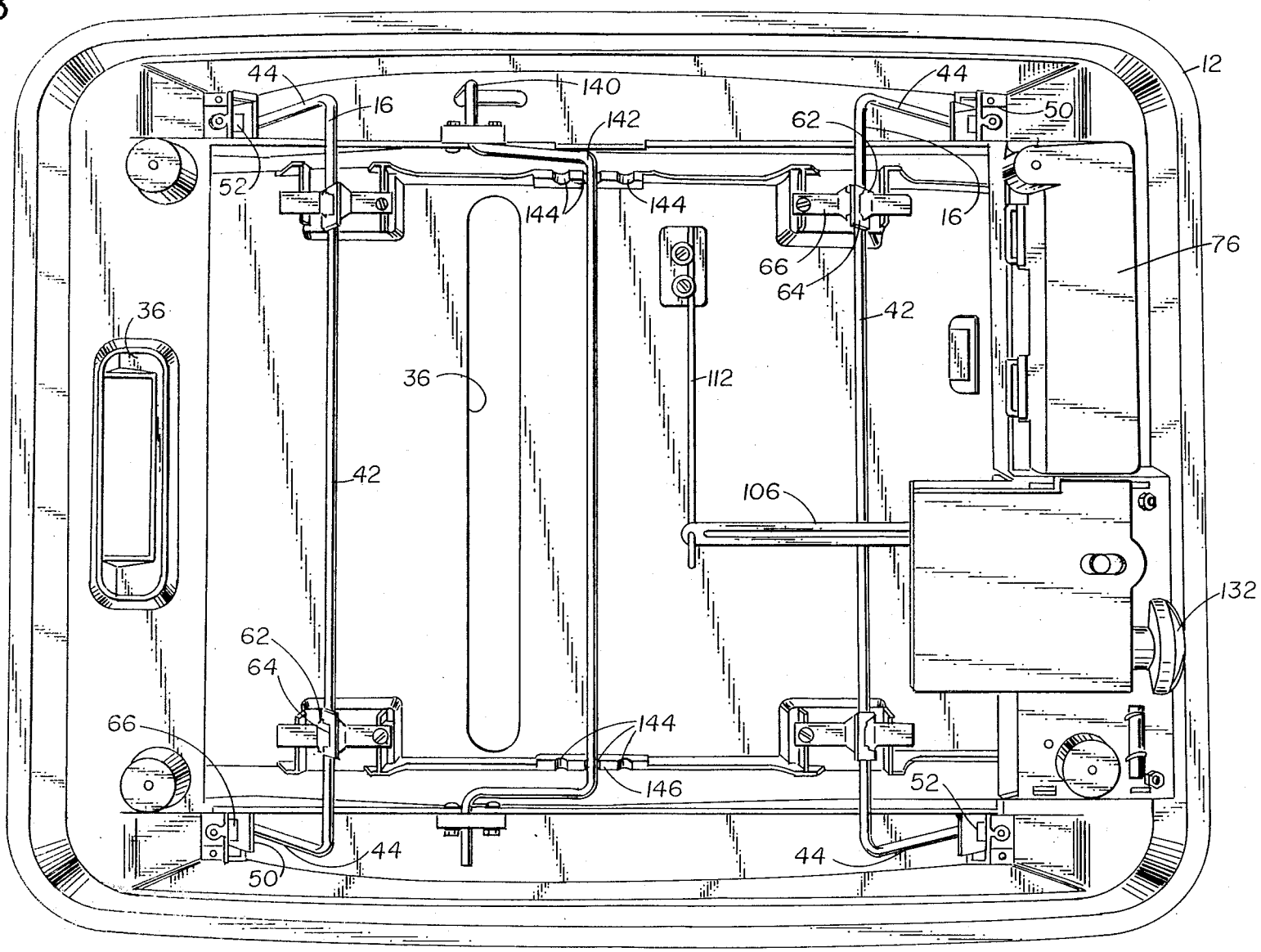
FIG. 3 is a bottom view of the rocker assembly shown in FIGS. 1 and 2.

With reference to FIG. 1, there is shown the rocker assembly 10 as constructed of two (2) major components, the base 12 and the intermediate platform 14. The base adapted to be is fixedly located during operation and use and the platform is movable with respect to the base. The platform is rockably secured with respect to the base by relatively rigid, generally U-shaped hanger wires or links 16. The upper region or surface 18 of the intermediate platform 14 is contoured for the convenient receipt of any one of a number of commercially available infant seats 20 of a generally standard configuration. The base 12 and platform 14 are preferably each fabricated, as through injection molding, in a one-piece construction from a rigid, non-toxic, plastic material as, for example, polyethylene or polyvinyl chloride.

The base 12 includes a flat lower face 24 adapted to be supported on a planar surface during operation and use. An upstanding peripheral surface 26 extends therearound. In addition, hollow upstanding side walls 28 are formed along two lateral side edges. The front or head end 32 and the back or foot end 34 of the base are open to allow for the positioning of the platform between the side walls 28. This configuration of the base allows for movement of the platform forwardly and rearwardly above the lower extent of the base.

The intermediate platform is formed with an upper region with a surface 18 arcuately shaped to conform with the arcuately shaped lower surface of a conventional infant seat 20 to be supported thereon. Formed in the upper face of the platform are slots 36 sized and located for receiving cooperable brackets or the like on the lower surface of many conventional infant seats so as to support such seats in a sitting, or in a reclining orientation. An aperture 38 is also formed in the base for functioning as a handle for carrying purposes.

Securement between the base 12 and platform 14 is effected by a pair of similarly shaped stiff wire hangers or links 16. Each link is formed into a generally U-shaped configuration. The lower portion 42 of their extents are horizontal, laterally extending from side-to-side of the base and Platform, beneath the lower region or surface of the platform. Vertically extending portions 44 extend upwardly therefrom. Thereafter, their ends 46 are bent outwardly in a horizontal orientation forming short horizontal portions for being received and supported by the base 12 in the four corners thereof within the side walls.

Figure 5:
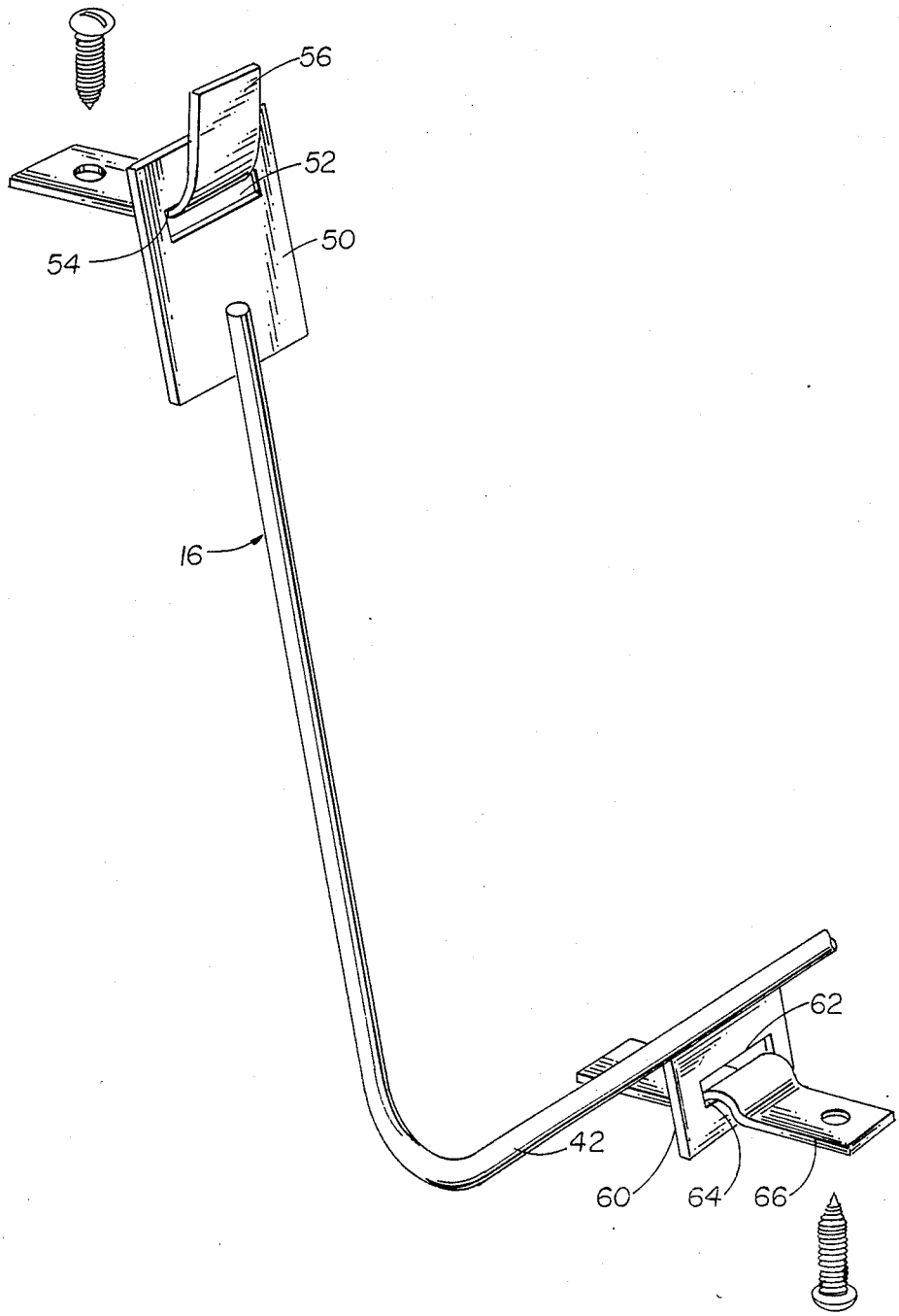
FIG. 5 is a perspective illustration of one side of one link coupling the base and the platform.

Greater efficiency is added to the rocking motion through the use of low friction hinges. Note FIG. 5. More specifically, the upper horizontal portions of the links 16 are provided with rockable hinge plates 50 with apertures 52, the upper edges 54 of which constitute knife edge bearings in the zone where they couple with the fixed side walls. In cooperation therewith, the front and rear ends of the side walls are provided with metallic supports or journals 56 positioned through the apertures 52 for receiving and supporting the hinge plates 50 and the links 16. In this manner a knife edge hinge is created at the upper edges of the hanging wires.

In like fashion, the lower horizontal portions 42 of the links 16 are provided adjacent their edges with depending metal plates 60 with apertures 62, the lower edges 64 of which constitute knife edge bearings for supporting thereon generally horizontal hinge plates or journals 66 secured at their ends from downwardly extending projections 68 at the corners of the platform. Journals 66 are preferably provided with semi-circular bonds for properly retaining the journals 66 and platform 14 in proper location with respect to plates 60 and base 12. In this manner, all four corners of the platform 14 being supported for rocking and all four corner of the base 12 adapted for supporting the platform 14 have knife edge hinges for minimum of friction and maximum efficiency to reduce power consumption during operation and use. Removable panels 72 are provided on the upper surface of the base 12 at all four (4) corners to provide access to the upper hinges as may become necessary or desirable.

Figure 6:
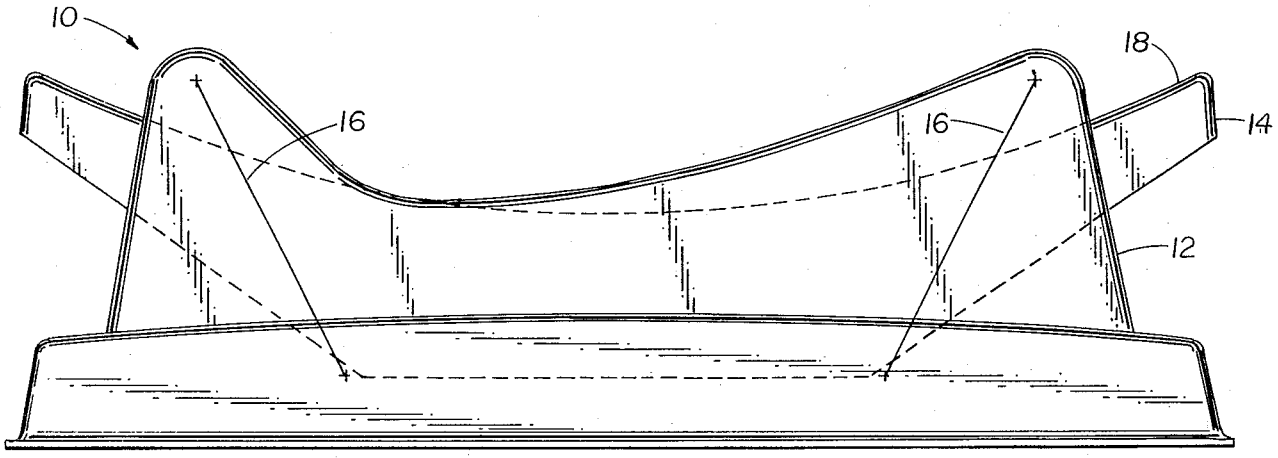
FIGS. 6 and 7 are schematic illustrations of the rocker assembly shown in the prior Figures with the platform in alternate positions demonstrating the rocking.
Figure 7:
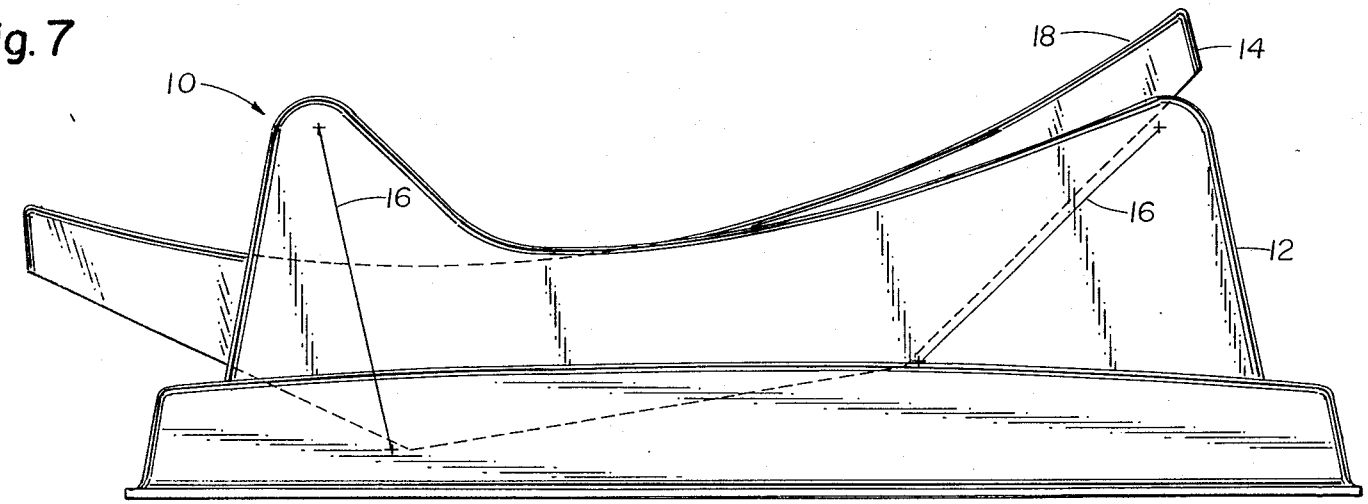

FIGS. 6 and 7 illustrate the links 16, first with the platform 14 centrally suspended by gravity and then with the platform 14 in an end-most rocked position. This illustrates the path of movement of the platform 14 and links 16 with respect to the fixed base 12. The rigid nature of the U-shaped links makes them act to reciprocate in a planar-type motion assuring that the intermediate platform and supported infant seat and child will move in planes parallel to the central plane of the base.

Motion is imparted to the platform to effect its rocking motion through a motor 74 powered by two (2) D-batteries located in a battery case 76 formed within the base. A sliding switch 78 allows for variable voltage to the motor in the conventional manner for effecting a variable speed to the platform 14. The motor 74 is provided with a horizontal drive shaft 80 having a rotatable worm gear 82, rotatable by the motor 74 and drive shaft 80. The worm gear in turn rotates a spur gear 84 about a vertical axis. An L-shaped arm 86 is secured to a shiftable plate 88 in the base with the motor and gears supported therewith. The shiftable plate 88 has a first or remote end having a rib 90 located in a slot 92 formed in the base. The slot 92 constrains the movement of the shiftable plate 88, arm 86 and motor 74 to a predetermined linear path. The central portion 94 of the L-shaped arm 86 is likewise secured to the plate 88 as is the near end 96 of the arm.

The axis of the spur gear supports a drive pin 98 for rotation about its lower end 100. The upper end 102 of the pin 98 is off set from the axis of its lower end 100 which is the axis of the spur gear 84. A drive bar 106 is secured at its first end 108 to the upper end 102 of the pin 98 and at its second end 110 to a leaf spring 112. The leaf spring is, in turn, removably secured to the lower surface of the platform 14 through screws 114 and washers 116. In this manner, rotation of the motor 74 and its worm gear 82 will rotate the spur gear 84 for imparting a rotary motion to the pin 98 and the first end 108 of the drive bar 106.

The second end 110 of the drive bar 106 will effect a generally reciprocal motion to the end 126 of the leaf spring 112 remote from its coupling to the lower surface of the platform. In this manner, because of the resiliency of the leaf spring, the full throw of the drive bar 106 will need not result in an identical movement of the platform 14. This is because a significant portion of the drive bar movement may be absorbed in the bending of the leaf spring. As a result, the movement of the platform and supported infant seat is flexibly coupled to the throw of the drive bar 106. The result is a softer, more relaxed movement for the infant being rocked, a movement approaching that which would be imparted by a mother's hand. Similarly, because of the resilience of the leaf spring 112, the infant seat 20 and platform 14 may be rocked by hand at a different speed or at a different amplitude than that being provided by the motor 74. The infant seat 20 and platform 14 may also be stopped by grabbing the platform or infant regardless of the continued movement of the motor. Further, rocking will cease if a foreign object, such as a child's hand, were placed between the platform 14 and base 12.

Figure 4:
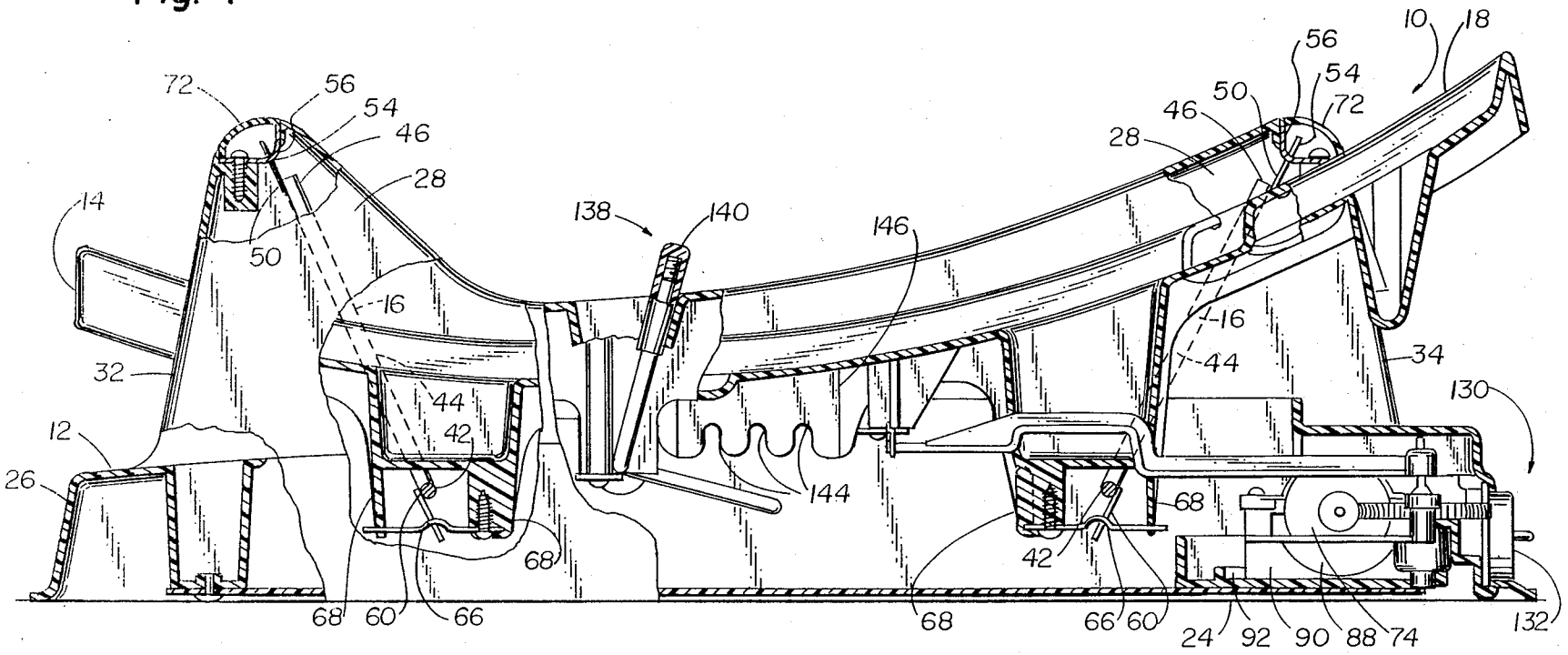
FIG. 4 is a side elevational view of the rocker assembly shown in the prior Figures with certain parts removed to show certain internal construction thereof.

The instant invention also involves the use of a rocker midpoint adjustment mechanism 130. Such mechanism includes a dial 132 fixed longitudinally to the base with internal screw threads which may be rotated as shown in FIG. 4 to allow the shiftable plate and motor assembly to be repositioned longitudinally. Such adjustable movement will vary the location of the motor 74, gears 82 and 84, drive bar 106 and leaf spring 112 which will, in turn, adjust the center of oscillation of the platform 14. In this manner, the assembly 10 may be adjusted as a function of the size and center of gravity of the child being rocked so as to ensure the most coordinated movement of the platform and the drive mechanism.

The entire geometry of the assembly with its motion imparting mechanisms and adjustment mechanisms is matched to effect the natural period of movement of the platform and child about forty (40) cycles per minute. Such natural period is maintained through adjustment of the assembly for accommodating children of varying sizes and centers of gravity as well as different infant seats.

Mechanisms 138 for locking the platform 14 with respect to the base 12 are also provided. Such locking is effected through a lever 140. When rotated counter clock wise in the base 12 as shown in FIG. 4, the lever will move an L-shaped rigid wire 142 into engagement with one of a plurality of slots 144 in spaced plates 146 depending downwardly from the platform 14. Wire 144 is shaped appropriately and journaled for rotation in opposite sides of the base. This lever movement will effectively lock the platform 14 with respect to the base 12 in any one of a plurality of positions corresponding to the employed slot 144 independent of the action of the motor 74 to thereby preclude movement of the platform 14 with respect to the base 12 when so locked so as to allow putting a child into a fixed rather than moving device and to allow the rocker to be used as a stationary device.

The present disclosure includes that contained in the appended claims as well as that of the foregoing description. Although this invention has been described in its preferred forms with a certain degree of particularity, it is understood that the present disclosure of the preferred form has been made only by way of example an numerous changes in the details of construction and combination and arrangement of parts may be resorted to without departing from the spirit and scope of the invention.

Now that the invention has been described,

What is claimed is:

1. A rocker assembly for an infant seat comprising in combination:

a base having upstanding lateral side walls defining an opening therebetween;

an intermediate platform positioned within the opening and having an upper region adapted to receive an infant seat thereon;

generally U-shaped link means having upper portions supported by the side walls, a lower horizontal portion adapted to receive a lower region of the platform thereon, and intermediate vertical portions coupling the upper and lower portions; and drive means coupling the platform and the base for inducing a rocking motion to the platform, the drive means including a motor mounted within the base and a mechanism flexibly coupling the motor and the platform whereby movement of one end of the mechanism by the motor will tend to effect a movement of the other end of the mechanism connected to the platform, the mechanism being formed as a leaf spring.

2. The assembly as set forth in claim 1 wherein the link means are comprised of two brackets coupling the opposite ends of the walls with the opposite ends of the platform.

3. The assembly as set forth in claim 2 wherein the link means are each provided with apertured plates with edges formed as knife edge bearings adapted to engage with journals in the base and platform to thereby constitute low friction hinges.

4. A rocker assembly comprising in combination:

a base having a pair of upstanding walls defining an opening therebetween, the base also having four journal means located at the upper corners of the walls;

a support platform having a head end and a foot end spaced along the length thereof, the length being greater than the width at the head and foot ends, the platform being positioned within the opening and having four journal means mounted at the lower regions thereof wherein two pairs of journals are located at the head end and foot end respectively;

two generally U-shaped link means each having upper portions supported by the walls, a lower horizontal portion adapted to receive the lower region of the support platform thereon to support the head end and foot end, and intermediate vertical portions coupling the upper portions and a lower portion, the upper and lower portions of the link means each having plates with openings forming knife edges therein adapted to engage with the journal means in the base and platform respectively to thereby constitute low friction hinges; and drive means coupling the platform and the base for inducing a rocking motion to the platform along its length.

5. The assembly as set forth in claim 4 wherein the speed of the drive means is adjustable to match the natural period of the platform and child.

6. The assembly as set forth in claim 4 wherein the natural period of the platform and child is about forty (40) cycles per minute as effected by the geometry of the assembly.

7. The assembly as set forth in claim 4 wherein the drive means includes a motor mounted within the base and a leaf spring flexibly coupling the motor and the platform whereby movement of one end of the leaf spring by the motor will tend to effect a movement of the other end of the leaf spring connected to the platform.

8. The assembly as set forth in claim 4 and further including adjustment means to move the drive means and thereby longitudinally vary the center of oscillation of the rocking platform to compensate for varying centers of gravity of the platform and child.

9. The assembly as set forth in claim 8 wherein the adjustment means is a rotatable knob coupled to the motor and leaf spring for the longitudinal shifting thereof.

10. The assembly as set forth in claim 4 and further including locking means to secure the platform with respect to the base in any one of a plurality of positions.

11. The assembly as set forth in claim 10 wherein the locking means includes a plate downwardly extending from the platform with a plurality of longitudinally spaced slots formed therein and a rod pivotally secured to the base for positioning in a preselected one of the slots for securing the platform in a preselected orientation with respect to the base.

12. A rocker for an infant seat comprising in combination:

a base having upstanding lateral side walls defining an opening therebetween;

an intermediate platform positioned within the opening and having an upper region adapted to receive an infant seat thereon;

a pair of generally U-shaped links each having upper portions supported by the side walls, each having a lower horizontal portion adapted to receive a lower region of the platform thereon, and each having intermediate vertical portions coupling the upper and lower portions;

drive means coupling the platform and the base for inducing a rocking motion to the platform;

adjustment means to longitudinally vary the center of oscillation of the rocking platform; and locking means to lock the platform with respect to the base.

* * * * *